US005908681A

United States Patent [19]

Foster

[11] Patent Number: 5,908,681

[45] Date of Patent: Jun. 1, 1999

[54] PROTECTIVE TABLE COVERS

[76] Inventor: Patricia A. I. Foster, R.R. #2 Tottenham 4th Line, Simcoe County, Ontario, Canada, L0G 1W0

[21] Appl. No.: 09/044,311

[22] Filed: Mar. 19, 1998

[51] Int. Cl.[6] ..... A47B 13/08

[52] U.S. Cl. ..... 428/99; 150/158; 108/90

[58] Field of Search ..... 428/99; 150/158; 297/228.11, 228.12; 108/90

[56] References Cited

U.S. PATENT DOCUMENTS 1,684,173 9/1928 Diamond et al. ..... 150/158

*Primary Examiner*—Alexander Thomas

[57] ABSTRACT

A new protective table cover for preventing injuries caused by sharp corners and edges of coffee and end tables. The inventive device includes a cover member dimensioned for covering a top of a table. The cover member has a peripheral channel secured around an outer periphery thereof. The peripheral channel hangs over a peripheral edge of the top of the table. The peripheral channel has a supplemental peripheral flap extending outwardly from a lower edge of the peripheral channel. The supplemental peripheral flap has an elastic band secured therein for securement to an underside of the top of the table. A padded strip is disposed within the peripheral channel and extends an entire distance therearound.

5 Claims, 2 Drawing Sheets

PROTECTIVE TABLE COVERS

BACKGROUND OF THE INVENTION

1. Field of the Invention

The present invention relates to cover guards and more particularly pertains to a new protective table cover for preventing injuries caused by sharp corners and edges of coffee and end tables.

2. Description of the Prior Art

The use of cover guards is known in the prior art. More specifically, cover guards heretofore devised and utilized are known to consist basically of familiar, expected and obvious structural configurations, notwithstanding the myriad of designs encompassed by the crowded prior art which have been developed for the fulfillment of countless objectives and requirements.

Known prior art cover guards include U.S. Pat. No. 4,582,739 to Givens; U.S. Pat. No. 4,817,902 to Mason; U.S. Pat. No. 3,960,354 to Simikoski; U.S. Pat. No. Des. 207,680 to Pratt; U.S. Pat. No. 3,093,924 to Pompa; WO 96/37127 to Chasan et al.; and EP 0 317 027 A1 to Sluiter.

While these devices fulfill their respective, particular objectives and requirements, the aforementioned patents do not disclose a new protective table cover. The inventive device includes a cover member dimensioned for covering a top of a table. The cover member has a peripheral channel secured around an outer periphery thereof. The peripheral channel hangs over a peripheral edge of the top of the table. The peripheral channel has a supplemental peripheral flap extending outwardly from a lower edge of the peripheral channel. The supplemental peripheral flap has an elastic band secured therein for securement to an underside of the top of the table. A padded strip is disposed within the peripheral channel and extends an entire distance therearound.

In these respects, the protective table cover according to the present invention substantially departs from the conventional concepts and designs of the prior art, and in so doing provides an apparatus primarily developed for the purpose of preventing injuries caused by sharp corners and edges of coffee and end tables.

SUMMARY OF THE INVENTION

In view of the foregoing disadvantages inherent in the known types of cover guards now present in the prior art, the present invention provides a new protective table cover construction wherein the same can be utilized for preventing injuries caused by sharp corners and edges of coffee and end tables.

The general purpose of the present invention, which will be described subsequently in greater detail, is to provide a new protective table cover apparatus and method which has many of the advantages of the cover guards mentioned heretofore and many novel features that result in a new protective table cover which is not anticipated, rendered obvious, suggested, or even implied by any of the prior art cover guards, either alone or in any combination thereof.

To attain this, the present invention generally comprises a cover member dimensioned for covering a top of a table. The cover member has a peripheral channel secured around an outer periphery thereof. The peripheral channel hangs over a peripheral edge of the top of the table. The peripheral channel has a supplemental peripheral flap extending outwardly from a lower edge of the peripheral channel. The supplemental peripheral flap has an elastic band secured therein for securement to an underside of the top of the table. A padded strip is disposed within the peripheral channel and extends an entire distance therearound. A pair of straps are coupled with opposing sides of the cover member at the supplemental peripheral flap thereof. Each of the straps extend between the opposing sides of the cover member and cross over each other at a central point below a center of the cover member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new protective table cover apparatus and method which has many of the advantages of the cover guards mentioned heretofore and many novel features that result in a new protective table cover which is not anticipated, rendered obvious, suggested, or even implied by any of the prior art cover guards, either alone or in any combination thereof.

It is another object of the present invention to provide a new protective table cover which may be easily and efficiently manufactured and marketed.

It is a further object of the present invention to provide a new protective table cover which is of a durable and reliable construction.

An even further object of the present invention is to provide a new protective table cover which is susceptible of a low cost of manufacture with regard to both materials and labor, and which accordingly is then susceptible of low prices of sale to the consuming public, thereby making such protective table cover economically available to the buying public.

Still yet another object of the present invention is to provide a new protective table cover which provides in the apparatuses and methods of the prior art some of the advantages thereof, while simultaneously overcoming some of the disadvantages normally associated therewith.

Still another object of the present invention is to provide a new protective table cover for preventing injuries caused by sharp corners and edges of coffee and end tables.

Yet another object of the present invention is to provide a new protective table cover which includes a cover member dimensioned for covering a top of a table. The cover member has a peripheral channel secured around an outer periphery thereof. The peripheral channel hangs over a peripheral edge of the top of the table. The peripheral channel has a supplemental peripheral flap extending outwardly from a lower edge of the peripheral channel. The supplemental peripheral flap has an elastic band secured therein for securement to an underside of the top of the table. A padded strip is disposed within the peripheral channel and extends an entire distance therearound.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
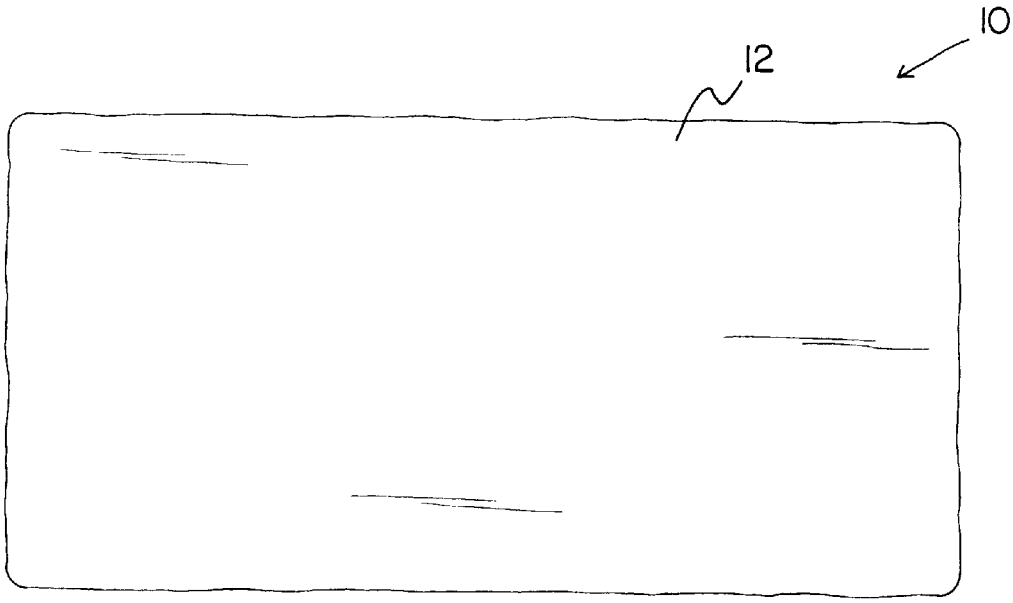
FIG. 1 is a top plan view of a new protective table cover according to the present invention.
Figure 2:
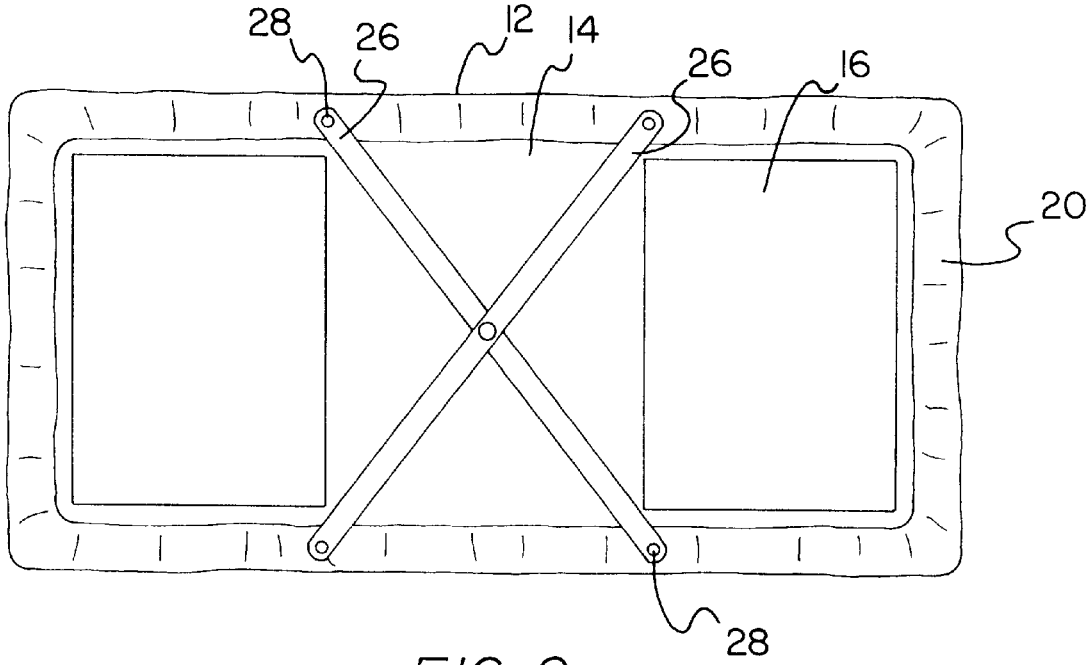
FIG. 2 is a bottom plan view of the present invention shown secured to a table.
Figure 3:
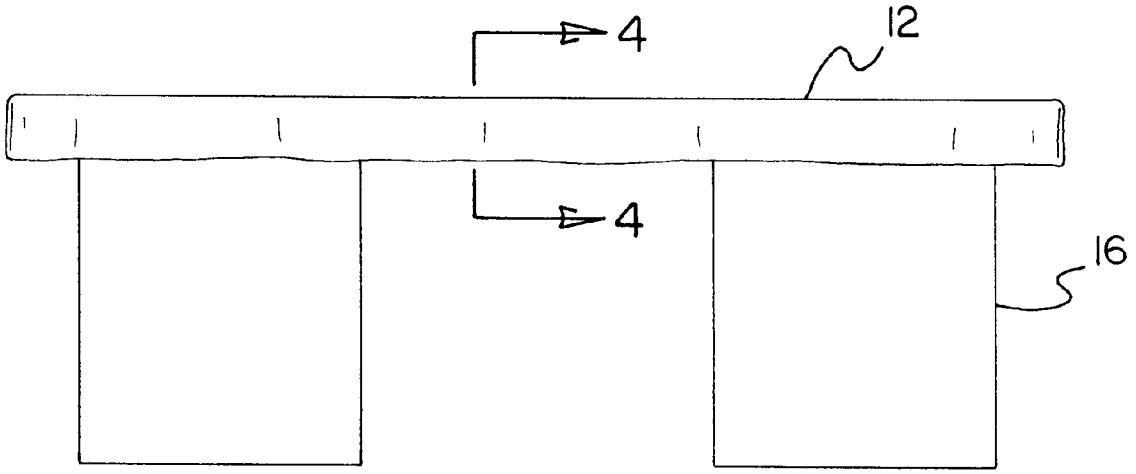
FIG. 3 is a side view of the present invention shown secured to a table.
Figure 4:
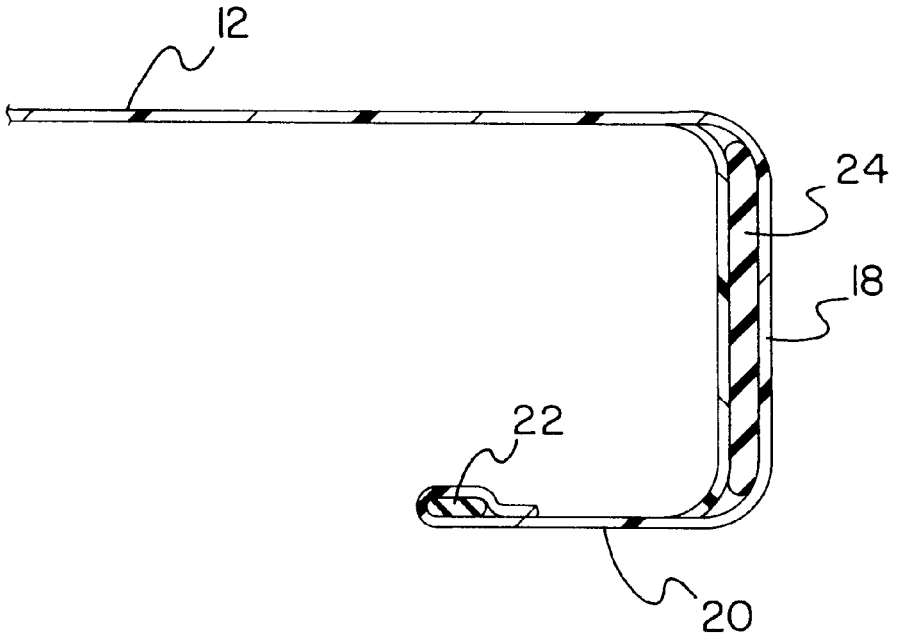
FIG. 4 is a cross-sectional view of the present invention as taken along line 4—4 of FIG. 3.

With reference now to the drawings, and in particular to FIGS. 1 through 4 thereof, a new protective table cover embodying the principles and concepts of the present invention and generally designated by the reference numeral 10 will be described.

As best illustrated in FIGS. 1 through 4, the protective table cover 10 comprises a cover member 12 dimensioned for covering a top 14 of a table 16. The cover member 12 has a peripheral channel 18 secured around an outer periphery thereof. The peripheral channel 18 hangs over a peripheral edge of the top 14 of the table 16. The peripheral channel 18 has a supplemental peripheral flap 20 extending outwardly from a lower edge of the peripheral channel 18. The supplemental peripheral flap 20 has an elastic band 22 secured therein for securement to an underside of the top 14 of the table 16.

A padded strip 24 is disposed within the peripheral channel 18 and extends an entire distance therearound.

A pair of straps 26 are coupled with opposing sides of the cover member 12 at the supplemental peripheral flap 20 thereof. Each of the straps 26 extend between the opposing sides of the cover member 12 and cross over each other at a central point below a center of the cover member 12. The pair of straps 26 are provided with button clips 28 to allow for its securement to the cover member 12. The straps 26 will prevent the inadvertent removal of the cover member 12 from the table 16.

In use, the present invention provides a cushioned bumper of foam rubber that would extend around the perimeter of the table 16. This bumper would have an elastic band 22 over it to give it a snug fit over the top 14 of the table 16. The cover member 12 would protect the surface of the top 14 from scratches and other damage The padding 24 would extend slightly above the level of the cover member 12 to cushion against falls and bumps coming from above the table 16.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new protective table cover for preventing injuries caused by sharp corners and edges of coffee and end tables comprising, in combination:

a cover member dimensioned for covering a top of a table, the cover member having a peripheral channel secured around an outer periphery thereof, the peripheral channel hanging over a peripheral edge of the top of the table, the peripheral channel having a supplemental peripheral flap extending outwardly from a lower edge of the peripheral channel, the supplemental peripheral flap having an elastic band secured therein for securement to an underside of the top of the table;

a padded strip disposed within the peripheral channel and extending an entire distance therearound; and a pair of straps coupled with opposing sides of the cover member at the supplemental peripheral flap thereof, each of the straps extending between the opposing sides of the cover member and crossing over each other at a central point below a center of the cover member.

2. The protective table cover as set forth in claim 1 wherein the cover member has a generally rectangular configuration.

3. A new protective table cover for preventing injuries caused by sharp corners and edges of coffee and end tables comprising, in combination:

a cover member dimensioned for covering a top of a table, the cover member having a peripheral channel secured around an outer periphery thereof, the peripheral channel hanging over a peripheral edge of the top of the table, the peripheral channel having a supplemental peripheral flap extending outwardly from a lower edge of the peripheral channel, the supplemental peripheral flap having an elastic band secured therein for securement to an underside of the top of the table; and a padded strip disposed within the peripheral channel and extending an entire distance therearound.

4. The protective table cover as set forth in claim 3 and further including a pair of straps coupled with opposing sides of the cover member at the supplemental peripheral flap thereof.

5. The protective table cover as set forth in claim 4 wherein each of the straps extend between the opposing sides of the cover member and cross over each other at a central point below a center of the cover member.

* * * * *